US012366396B2

(12) United States Patent
Cho et al.

(10) Patent No.: US 12,366,396 B2
(45) Date of Patent: Jul. 22, 2025

(54) REFRIGERATOR

(71) Applicant: SAMSUNG ELECTRONICS CO., LTD., Suwon-si (KR)

(72) Inventors: Jaepil Cho, Suwon-si (KR); Hyoju Han, Suwon-si (KR); Byungkwan Yang, Suwon-si (KR); Jooyong Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 169 days.

(21) Appl. No.: 18/237,219

(22) Filed: Aug. 23, 2023

(65) Prior Publication Data

US 2024/0175619 A1 May 30, 2024

Related U.S. Application Data

(63) Continuation of application No. PCT/KR2023/011857, filed on Aug. 10, 2023.

(30) Foreign Application Priority Data

Nov. 29, 2022 (KR) ..... 10-2022-0163441

(51) Int. Cl.
*F25C 1/24* (2018.01)

(52) U.S. Cl.
CPC ..... *F25C 1/24* (2013.01); *F25C 2400/06* (2013.01); *F25C 2400/10* (2013.01); *F25C 2400/14* (2013.01)

(58) Field of Classification Search
CPC ..... F25D 23/126
See application file for complete search history.

(56) References Cited

U.S. PATENT DOCUMENTS

| | | | |
|---|---|---|---|
| 7,316,124 | B2 | 1/2008 | Lee |
| 7,628,030 | B2 | 12/2009 | Visin et al. |
| 2020/0284493 | A1 | 9/2020 | Lee et al. |

FOREIGN PATENT DOCUMENTS

| | | | |
|---|---|---|---|
| JP | 2001-153512 | A | 6/2001 |
| JP | 2003-56958 | A | 2/2003 |
| JP | 3541147 | A | 7/2004 |
| JP | 2006-078059 | A | 3/2006 |
| KR | 10-0210106 | B1 | 7/1999 |

(Continued)

OTHER PUBLICATIONS

English language translation of KR20164365 to Kim. Translated Apr. 2025 (Year: 2000).*

(Continued)

*Primary Examiner* — Cassey D Bauer
(74) *Attorney, Agent, or Firm* — Sughrue Mion, PLLC

(57) ABSTRACT

A refrigerator includes a main body, a freezing compartment and a refrigerating compartment disposed inside the main body, an evaporator disposed in a cooling flow path and provided to supply cold air to the freezing compartment, a freezing compartment duct disposed in the freezing compartment to supply cold air generated by the evaporator to the freezing compartment, an ice maker disposed inside the main body, a water supply pipe provided to penetrate the cooling flow path to be directed to the ice maker, and a cover member coupled to the freezing compartment duct to block a movement of air between a cooling flow path and the freezing compartment.

20 Claims, 14 Drawing Sheets

(56) References Cited

FOREIGN PATENT DOCUMENTS

| | | | | |
|---|---|---|---|---|
| KR | 20-1999-0030069 | U | 7/1999 | |
| KR | 20-1999-0035994 | U | 9/1999 | |
| KR | 200164365 | Y1 * | 2/2000 | ..... F25D 23/061 |
| KR | 20-0180227 | Y1 | 5/2000 | |
| KR | 20-2000-0011225 | U | 6/2000 | |
| KR | 10-2001-0019693 | A | 3/2001 | |
| KR | 10-2004-0090428 | A | 10/2004 | |
| KR | 10-2005-0094301 | A | 9/2005 | |
| KR | 10-2020-0107390 | A | 9/2020 | |

OTHER PUBLICATIONS

International Search Report dated Nov. 29, 2023 in International Application No. PCT/KR2023/011857.
Written Opinion dated Nov. 29, 2023 in International Application No. PCT/KR2023/011857.

* cited by examiner

REFRIGERATOR

CROSS-REFERENCE TO RELATED APPLICATION

This application is a bypass continuation application of International Application No. PCT/KR2023/011857, filed on Aug. 10, 2023, which is based on and claims the benefit of a Korean Patent Application No. 10-2022-0163441, filed on Nov. 29, 2022 in the Korean Intellectual Property Office, the disclosure of each of which is incorporated by reference herein in its entirety.

BACKGROUND

Field

The present disclosure relates to a refrigerator, and more particularly, to a refrigerator including an ice maker.

Description of the Related Art

A refrigerator is a home appliance that includes a main body having a storage compartment and a cold air supply device provided to supply cold air to the storage compartment to keep food fresh.

Refrigerators may be classified into a bottom mounted freezer (BMF) type refrigerator in which a freezing compartment is located at a lower portion and a refrigerating compartment is located at an upper portion, a top mounted freezer (TMF) type refrigerator in which a freezing compartment is located at an upper portion and a refrigerating compartment is located at a lower portion, and a side by side (SBS) type refrigerator in which a freezing compartment and a refrigerating compartment are located in a left-right direction, depending on locations of the refrigerating compartment and the freezing compartment.

An evaporator may be installed in each of a refrigerating compartment and a freezing compartment to supply cold air to the refrigerating compartment and the freezing compartment. Cold air may be supplied to the refrigerating compartment and the freezing compartment through a single evaporator.

A refrigerator may include an ice maker for making ice and a water supply pipe for supplying water to the ice maker.

The present disclosure is directed to providing a refrigerator capable of fixing a position of a water supply pipe supplying water to an ice maker.

The present disclosure is directed to providing a refrigerator capable of preventing external cold air from being introduced into a storage compartment.

The present disclosure is directed to providing a refrigerator capable of preventing cold air in a storage compartment from escaping to the outside.

Technical tasks to be achieved in this document is not limited to the technical tasks mentioned above, and other technical tasks not mentioned will be clearly understood by those skilled in the art from the description below.

SUMMARY

An aspect of the present disclosure provides a refrigerator including a main body, a freezing compartment and a refrigerating compartment disposed inside the main body, an evaporator provided to supply cold air to the freezing compartment, a freezing compartment duct disposed in the freezing compartment to supply cold air generated by the evaporator to the freezing compartment, a first cooling flow path formed at a rear of the freezing compartment duct, the evaporator being disposed in the first cooling flow path, a second cooling flow path formed inside the freezing compartment duct so that air passed through the first cooling flow path moves to the freezing compartment, an ice maker disposed inside the main body, a water supply pipe provided to penetrate the first cooling flow path and the second cooling flow path to be directed to the ice maker and a cover member coupled to the freezing compartment duct and the freezing compartment duct includes a duct plate forming a front surface of the freezing compartment duct, a duct cover coupled to a rear side of the duct plate to form the second cooling flow path, and a passing hole provided on the duct plate and the duct cover to allow the water supply pipe to pass through the passing hole, and the cover member is coupled to a front side of the duct plate to block a movement of air between the first cooling flow path and the freezing compartment and provided to cover the passing hole.

The cover member may include a cover member hole provided to allow the water supply pipe to pass through the cover member hole, and the cover member hole may be formed to correspond to a diameter of the water supply pipe to fix the water supply pipe.

The cover member may include a body part provided to seal the passing hole, and a cover part disposed in front of the body part and coupled to the duct plate.

The cover part may include a wire passing hole provided to allow a wire provided to supply power to the ice maker to pass through the wire passing hole.

The passing hole may include a duct cover passing hole formed on the duct cover to communicate the first cooling flow path and the second cooling flow path, and a duct plate passing hole formed on the duct plate to communicate the second cooling flow path and an inner space of the freezing compartment.

The duct plate may include an accommodating portion disposed adjacent to the duct plate passing hole and recessed to accommodate the body part.

The accommodating portion may include a coupling groove provided such that the body part is coupled to the coupling groove, and the body part may include a coupling protrusion provided to correspond to the coupling groove.

The duct plate may include a coupling hole provided to allow the cover part to be coupled to the coupling hole, and the cover part may include a hook provided to correspond to the coupling hole.

The ice maker may include a first ice making tray and a second ice making tray provided to make ice cubes having shapes different from each other, the water supply pipe may include a first water supply pipe provided to supply water to the first ice making tray and a second water supply pipe provided to supply water to the second ice making tray, the passing hole may include a first passing hole provided to allow the first water supply pipe to pass through the first passing hole and a second passing hole provided to allow the second water supply pipe to pass through the second passing hole, and the body part may include a first body part provided to cover the first passing hole and a second body part provided to cover the second passing hole.

The first body part and the second body part may be disposed to be spaced apart from each other.

The cover part may include an upper cover part and a lower cover part separable from the upper cover part.

The refrigerator may further include a blowing fan disposed inside the freezing compartment duct to generate flows in the first cooling flow path and the second cooling flow path, wherein the cover member may be disposed below the blowing fan.

The cover member disposed may be disposed above the evaporator.

The cover member may include an expandable polystyrene (EPS) material.

The water supply pipe may be disposed to be inclined downward toward the freezing compartment.

The ice maker may include a first ice making tray and a second ice making tray provided to make ice cubes having shapes different from each other, the water supply pipe may include a first water supply pipe provided to supply water to the first ice making tray and a second water supply pipe provided to supply water to the second ice making tray, the passing hole may include a first passing hole provided to allow the first water supply pipe to pass through the first passing hole and a second passing hole provided to allow the second water supply pipe to pass through the second passing hole, and the cover member may include a first side cover member, a second side cover member and an intermediate cover member disposed between the first side cover member and the second side cover member.

Another aspect of the present disclosure provides a refrigerator including a main body, a freezing compartment and a refrigerating compartment disposed inside the main body, an evaporator disposed in a cooling flow path and provided to supply cold air to the freezing compartment, a freezing compartment duct disposed in the freezing compartment to supply cold air generated by the evaporator to the freezing compartment, an ice maker disposed inside the main body, a water supply pipe provided to penetrate the cooling flow path to be directed to the ice maker, and a cover member coupled to the freezing compartment duct, and the freezing compartment duct may include a duct plate forming a front surface of the freezing compartment duct, a duct cover coupled to a rear side of the duct plate, and a passing hole provided on the duct plate and the duct cover to allow the water supply pipe to pass through the passing hole, and the cover member may be coupled to a front side of the duct plate to block a movement of air between the cooling flow path and the freezing compartment and provided to cover the passing hole.

The cover member may include a cover member hole provided to allow the water supply pipe to pass through the cover member hole, and the cover member hole may be formed to correspond to a diameter of the water supply pipe to fix the water supply pipe.

The cover member may include a body part provided to seal the passing hole, and a cover part disposed in front of the body part and coupled to the duct plate.

The cover part may include a wire passing hole provided to allow a wire provided to supply power to the ice maker to pass through the wire passing hole.

BRIEF DESCRIPTION OF THE DRAWINGS

The above and other aspects, features, and advantages of certain embodiments of the present disclosure will be more apparent from the following description taken in conjunction with the accompanying drawings.

DETAILED DESCRIPTION

Figure 1:
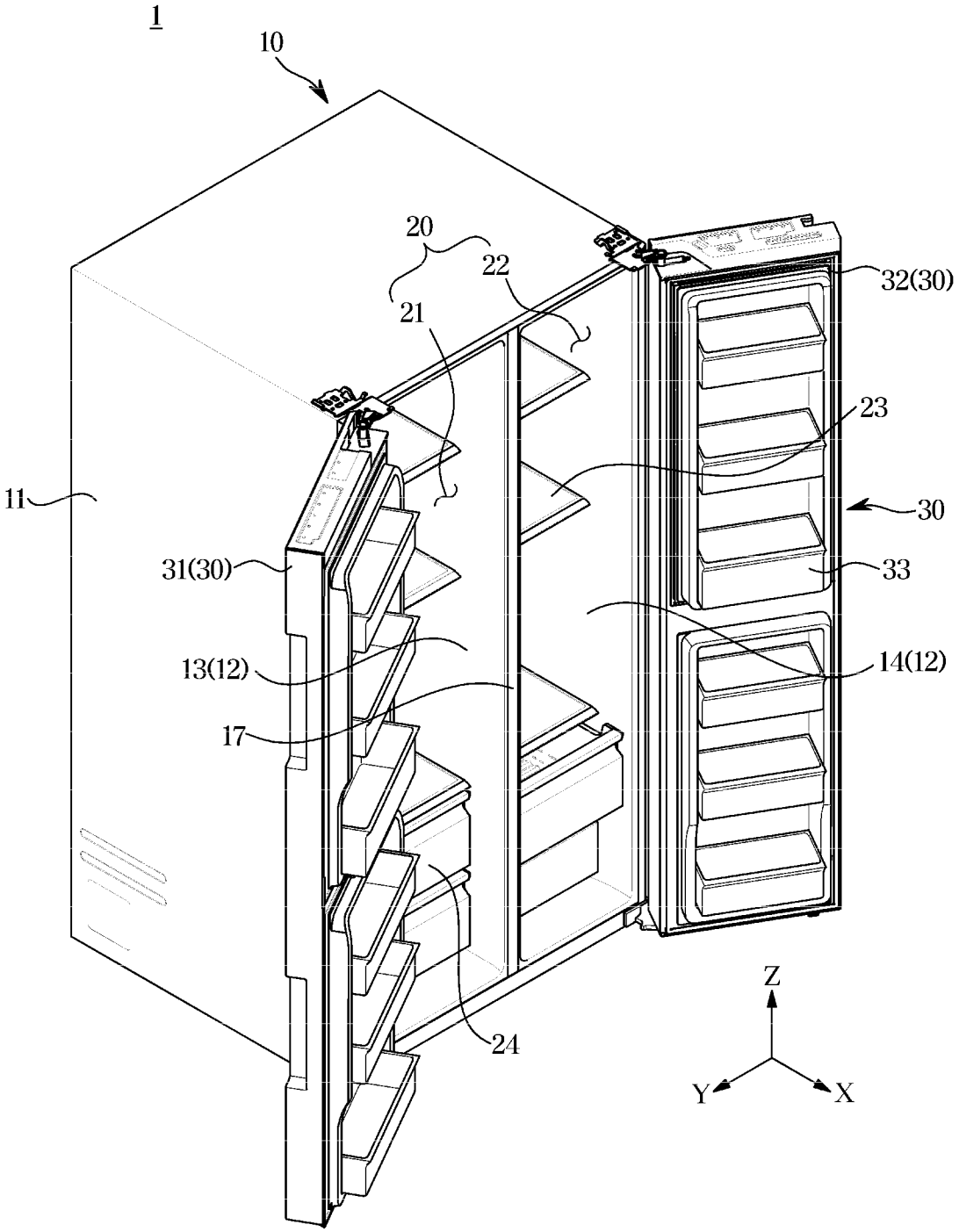
FIG. 1 is a perspective view of a refrigerator according to an embodiment of the present disclosure.

The embodiments described in the present specification and the configurations shown in the drawings are only examples of embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, components, parts, or combinations thereof described in the specification, and do not exclude the presence or addition of one or more other features, numbers, steps, operations, components, parts, or combinations thereof.

It will be understood that, although the terms first, second, etc. may be used herein to describe various components, these components should not be limited by these terms. The terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

Figure 2:
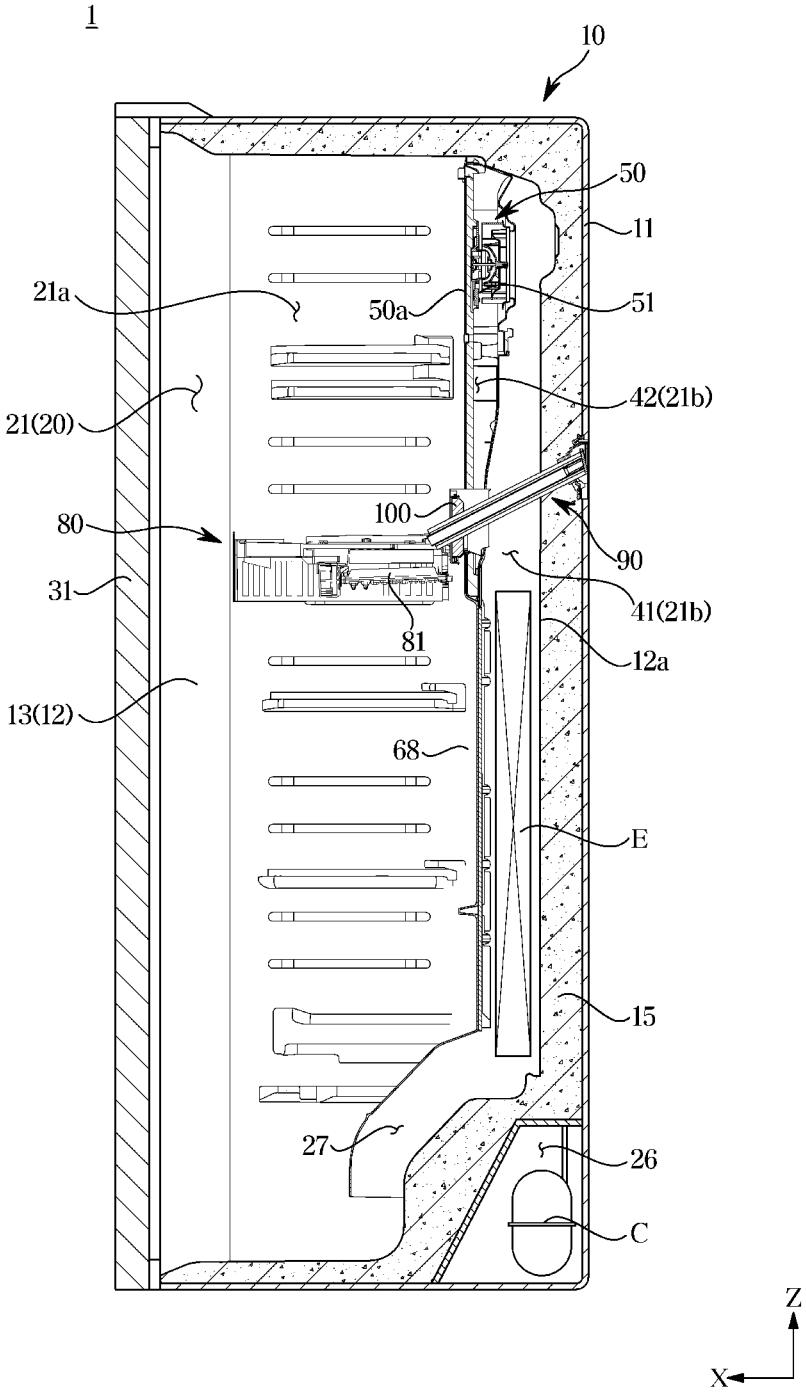
FIG. 2 is a side cross-sectional view of the refrigerator according to an embodiment of the present disclosure.
Figure 3:
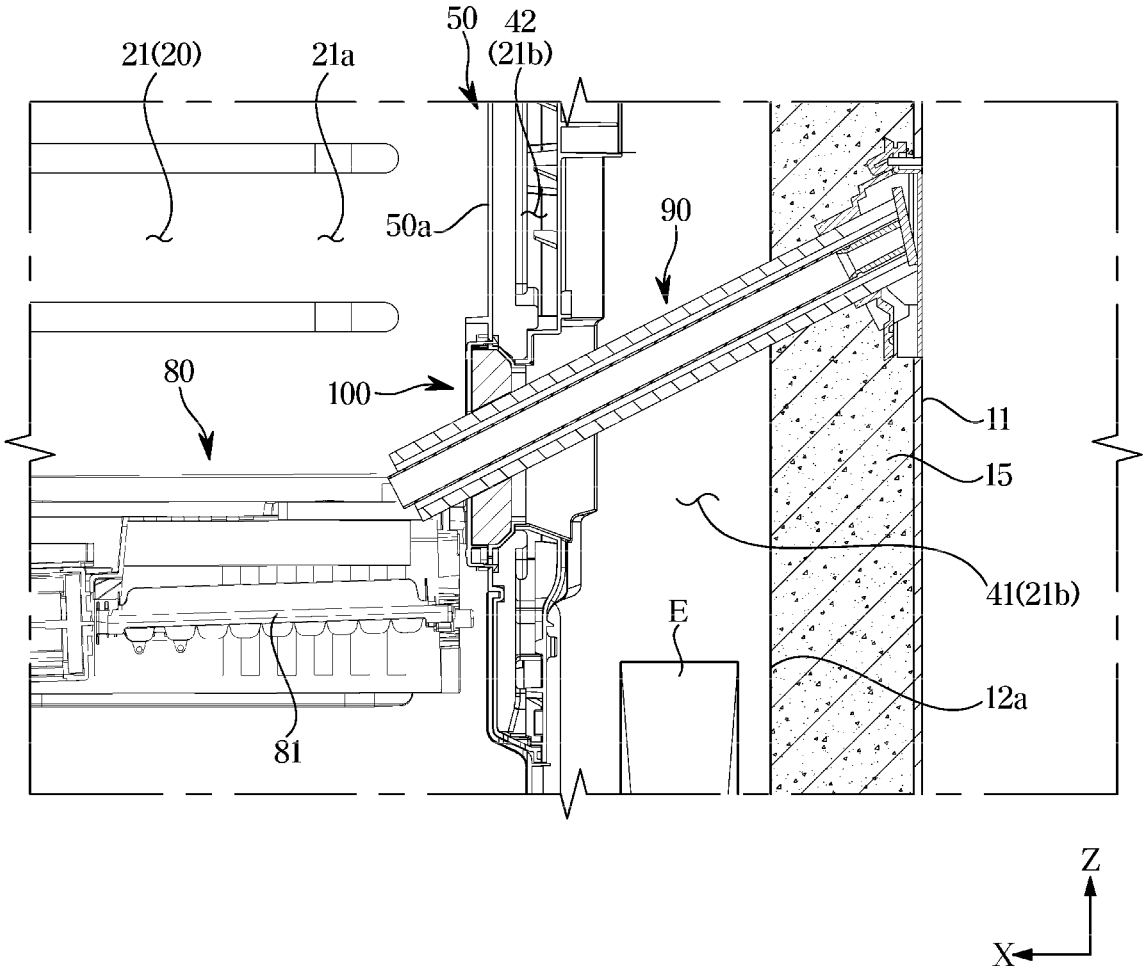
FIG. 3 is an enlarged view of a portion of the refrigerator illustrated in FIG. 2.
Figure 4:
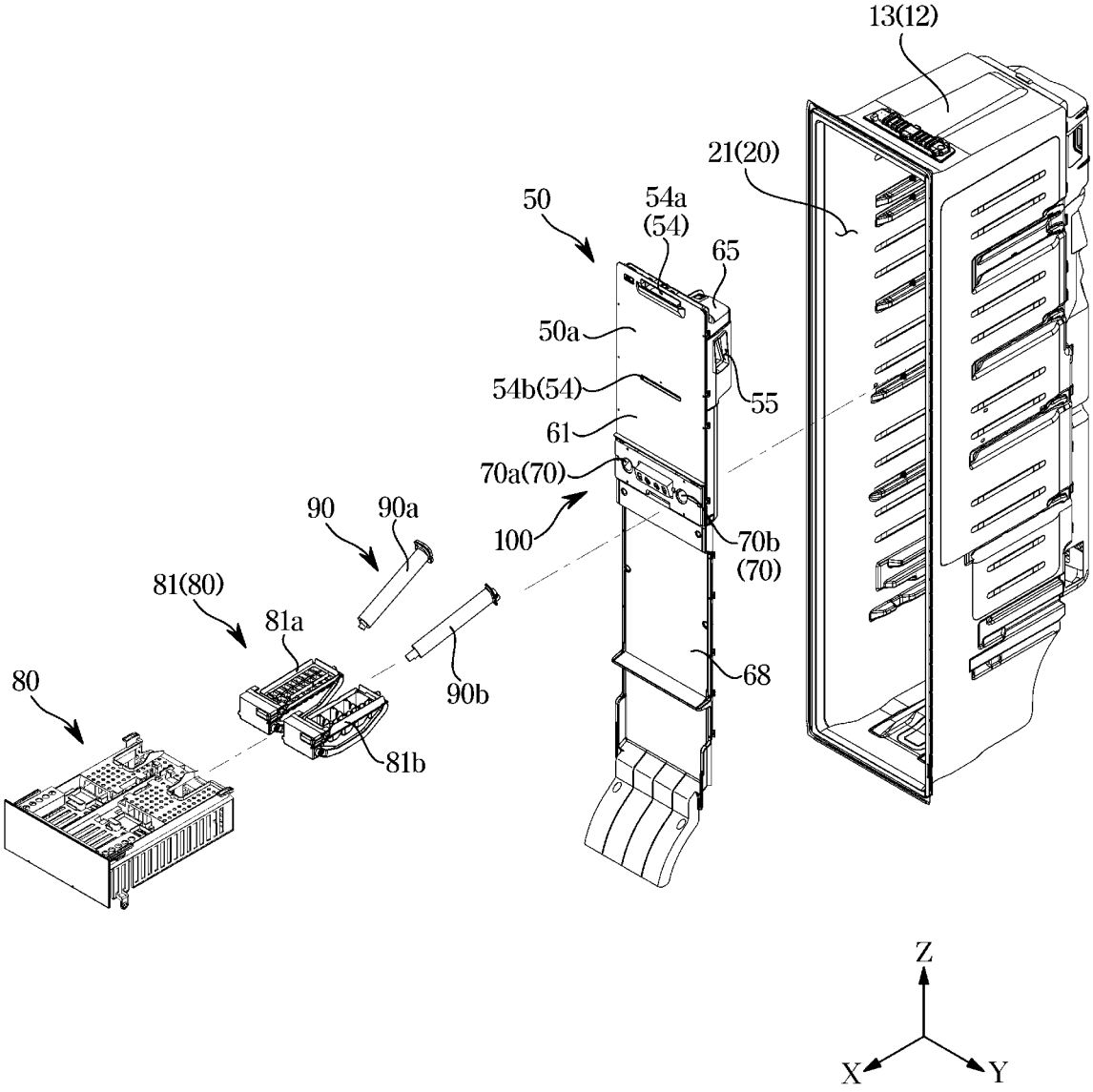
FIG. 4 is an exploded perspective view of components of the refrigerator according to an embodiment of the present disclosure.

FIG. 1 is a perspective view of a refrigerator according to an embodiment of the present disclosure. FIG. 2 is a side cross-sectional view of the refrigerator according to an embodiment of the present disclosure. FIG. 3 is an enlarged view of a portion of the refrigerator illustrated in FIG. 2. FIG. 4 is an exploded perspective view of components of the refrigerator according to an embodiment of the present disclosure.

A refrigerator 1 may include a main body 10 and a storage compartment 20 disposed inside the main body 10.

The main body 10 may include an outer case 11 and an inner case 12 coupled to an inner side of the outer case 11. The outer case 11 may form an exterior of the main body 10. The outer case 11 may be formed of a metal material.

The inner case 12 may form the storage compartment 20. The storage compartment 20 may include a first storage compartment 21 and a second storage compartment 22. The inner case 12 may be formed by injection molding of a plastic material. The inner case 12 may include a first inner case 13 forming the first storage compartment 21 and a second inner case 14 forming the second storage compartment 22.

A heat insulator 15 may be provided between the outer case 11 and the inner case 12. As the heat insulator 15, a urethane foam insulation may be used, and a vacuum insulation panel may be used together as necessary.

The storage compartment 20 may be provided such that a front of the storage compartment 20 is open inside the main body 10. The open front of the storage compartment 20 may be opened and closed by a door 30. A plurality of shelves 23 and storage boxes 24 may be provided inside the storage compartment 20 to store food and the like.

The storage compartment 20 may be partitioned into a plurality of storage compartments by a partition wall 17. The storage compartment 20 may include the first storage compartment 21 and the second storage compartment 22.

The first storage compartment 21 may be used as the freezing compartment 21 maintained at a temperature of substantially 0 to minus 30 degrees Celsius to store food in a frozen state. The first storage compartment 21 may be referred to as the freezing compartment 21.

The second storage compartment 22 may be used as the refrigerating compartment 22 maintained at a temperature of substantially 0 to 5 degrees Celsius to store food in a refrigerated state. The second storage compartment 22 may be referred to as the refrigerating compartment 22.

The freezing compartment 21 and the refrigerating compartment 22 may be disposed left and right. The refrigerator 1 may be of a side by side (SBS) type in which the storage compartment 20 is partitioned into left and right sides by the partition wall 17.

However, the refrigerator according to the present disclosure is not limited thereto, and may be a bottom mounted freezer (BMF) type in which the refrigerating compartment 22 and the freezing compartment 21 are disposed on an upper side and a lower side, respectively, or a top mounted freezer (TMF) type in which the freezing compartment 21 and the refrigerating compartment 22 are disposed on an upper side and a lower side, respectively. Alternatively, the storage compartment 20 may be partitioned into three or more storage compartments.

The door 30 is rotatably coupled to the main body 10 to open and close the open front of the storage compartment 20. A plurality of door guards capable of storing food and the like may be provided on a rear surface of the door 30.

The freezing compartment 21 and the refrigerating compartment 22 may be opened and closed by a first door 31 and a second door 32 rotatably coupled to the main body 10, respectively. The first door 31 may be the freezing compartment door 30. The second door 32 may be the refrigerating compartment door 30.

The inner case 12 may include the first inner case 13 forming the first storage compartment 21 and the second inner case 14 forming the second storage compartment 22. The first inner case 13 may be the freezing compartment inner case 13. The second inner case 14 may be the refrigerating compartment inner case 14. The freezing compartment inner case 13 and the refrigerating compartment inner case 14 may be disposed side by side on the left and right around the partition wall 17, respectively.

Referring to FIG. 2, the main body 10 may include a cold air supply device provided to supply cold air to the storage compartment 20.

The cold air supply device may include a compressor (not shown), a condenser (not shown), an expansion valve (not shown), and an evaporator E. A machine compartment 26 in which the compressor C and the condenser (not shown), which are provided to compress a refrigerant and condense the compressed refrigerant may be provided at a rear lower side of the storage compartment 20.

A circulation flow path 27 provided to communicate with the machine compartment 26 may be disposed at a lower portion of the freezing compartment inner case 13 so that circulated cold air is introduced into the machine compartment 26.

The cold air circulated in the freezing compartment 21 through the circulation flow path 27 may be introduced back into the machine compartment 26 to supply cold air to the freezing compartment 21 through the evaporator E.

The evaporator E may be provided to generate cold air. The evaporator E may be disposed in the freezing compartment 21. The evaporator E provided to supply cold air to the refrigerating compartment 22 and the freezing compartment 21 may be disposed in the freezing compartment 21. That is, the refrigerator 1 may include the single evaporator E.

However, the present disclosure is not limited thereto, and two or more of the evaporators E may be provided. For example, the evaporator E may be disposed in each of the freezing compartment 21 and the refrigerating compartment 22.

The evaporator E may be disposed at a rear lower side of the freezing compartment 21. A first cooling flow path 41 may be formed in a space between a rear surface 12*a* of the freezing compartment inner case 13 and a freezing compartment duct 50. The evaporator E may be disposed in the first cooling flow path 41.

Cold air generated by the evaporator E may move through the first cooling flow path 41. The cold air moving through the first cooling flow path 41 may be directed to the freezing compartment duct 50. The cold air moving through the first cooling flow path 41 may be directed upward.

The freezing compartment duct 50 to supply cold air to the freezing compartment 21 may be provided inside the freezing compartment 21. The freezing compartment duct 50 may be coupled to the freezing compartment inner case 13. The freezing compartment duct 50 may be the storage compartment duct 50.

The freezing compartment duct 50 may be provided to distribute the cold air supplied from the evaporator E to the freezing compartment 21 and/or the refrigerating compartment 22. The freezing compartment duct 50 may form a flow path to allow cold air to move. A plurality of the flow paths may be provided.

The freezing compartment 21 may include a storage space 21*a* for storing food and a cooling space 21*b* disposed at the rear of the storage space 21*a*. The storage space 21*a* and the cooling space 21*b* may be partitioned by the freezing compartment duct 50. The storage space 21*a* may be formed in front of the freezing compartment duct 50. The cooling space 21*b* may be formed inside the freezing compartment duct 50. The cooling space 21*b* may be formed at the rear of the freezing compartment duct 50. The cooling space 21*b* may include the first cooling flow path 41 and/or a second cooling flow path 42.

The freezing compartment duct 50 may distribute cold air supplied from the cooling space 21*b* to the storage space 21*a*. The air in the storage space 21*a* may be introduced into the cooling space 21*b* again through the circulation flow path 27.

Hereinafter, the cooling space 21*b* of the freezing compartment 21 may be referred to as a freezing compartment for convenience.

The freezing compartment duct 50 may be disposed at the rear of the freezing compartment 21. The freezing compartment duct 50 may form a rear surface of the freezing compartment 21. Specifically, the freezing compartment duct 50 may form a rear surface of the cooling space 21*b* of the freezing compartment 21.

The freezing compartment 21 may be formed by an inner surface of the freezing compartment inner case 13 and a front surface 50*a* of the freezing compartment duct 50. That is, the rear surface of the freezing compartment 21 may be formed by the front surface 50*a* of the freezing compartment duct 50, and side surfaces of the freezing compartment 21 may be formed by the inner surface of the freezing compartment inner case 13.

A blowing fan 51 may be disposed inside the freezing compartment duct 50. Cold air generated by the evaporator E may be sucked into the freezing compartment duct 50 by the blowing fan 51 and discharged into the freezing compartment 21.

The freezing compartment duct 50 may form the second cooling flow path 42. The second cooling flow path 42 may be formed from an inlet 52 of the freezing compartment duct 50 to outlets 54 and 55. The second cooling flow path 42 may be an inner space of the freezing compartment duct 50.

The first cooling flow path 41 and the second cooling flow path 42 may be connected. The second cooling flow path 42 may be provided downstream of the first cooling flow path 41. The cold air moved along the first cooling flow path 41 may be introduced into the second cooling flow path 42 through the inlet 52 of the freezing compartment duct 50.

The freezing compartment duct 50 may include the outlets 54 and 55. The outlets 54 and 55 may be provided to discharge the air moved to the second cooling flow path 42 to the outside of the freezing compartment duct 50. A plurality of the outlets 54 and 55 may be provided.

Figure 5:
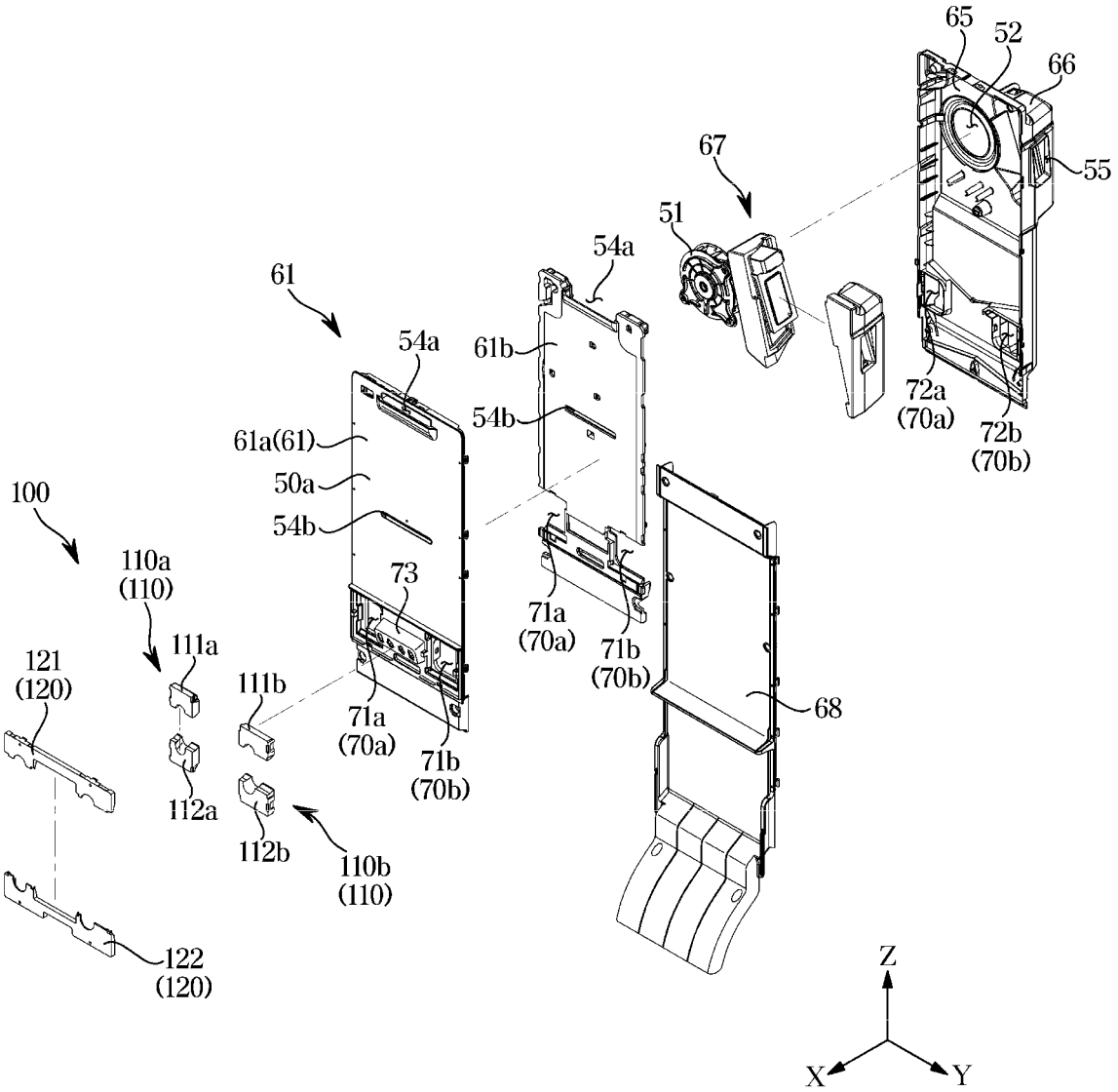
FIG. 5 is an exploded perspective view of a freezing compartment duct according to an embodiment of the present disclosure.

Referring to FIGS. 4 and 5, the outlets 54 and 55 may include the freezing compartment outlet 54. The freezing compartment outlet 54 may be provided to allow cold air to be discharge into the freezing compartment 21. The freezing compartment outlet 54 may be opened toward the freezing compartment 21.

A plurality of the freezing compartment outlets 54 may be provided. The freezing compartment outlet 54 may include a first freezing compartment outlet 54*a* and a second freezing compartment outlet 54*b* spaced apart from the first freezing compartment outlet 54*a*. The plurality of freezing compartment outlets 54 may be disposed in a vertical direction.

However, the present disclosure is not limited thereto, and one or three or more of the freezing compartment outlets 54 may be provided.

The outlets 54 and 55 may include the connection outlet 55. The connection outlet 55 may be provided to allow cold air to be discharged into the refrigerating compartment 22. Specifically, a refrigerating compartment duct (not shown) may be disposed in the refrigerating compartment 22 to supply cold air, and the connection outlet 55 may be connected to the refrigerating compartment duct (not shown). The connection outlet 55 may be provided to allow air in the freezing compartment duct 50 to be supplied to the refrigerating compartment duct (not shown).

The refrigerating compartment 22 may not additionally include an evaporator supplying cold air. Therefore, as cold air generated by the evaporator E communicating with the freezing compartment duct 50 is introduced into the refrigerating compartment duct (not shown) through the freezing compartment duct 50 and then discharged from the refrigerating compartment duct (not shown), the refrigerator compartment 22 may be maintained at a low temperature.

A damper 67 provided to open and close the connection outlet 55 may be provided in the freezing compartment duct 50. The damper 67 may selectively allow or block cold air in the freezing compartment duct 50 from being introduced into the refrigerating compartment duct (not shown). The damper 67 may be disposed inside the freezing compartment duct 50.

Referring to FIGS. 2 to 4, the refrigerator 1 may include an ice maker 80. The ice maker 80 may be provided to make ice.

The ice maker 80 may be disposed in the freezing compartment 21. The ice maker 80 may be disposed at a substantially central portion of the freezing compartment 21.

The ice maker 80 may make ice using cold air in the freezing compartment 21. However, the present disclosure is not limited thereto, and the ice maker 80 may be disposed in another location of the storage compartment 20 as long as it may make ice.

For example, the ice maker 80 may be disposed in the refrigerating compartment 22 or may be disposed in a separate ice making chamber (not shown).

The ice maker 80 may include an ice making tray 81. The ice making tray 81 may make ice by receiving water from a water supply pipe 90.

Referring to FIG. 4, a plurality of the ice making trays 81 may be provided in the refrigerator 1. The ice making tray 81 may include a first ice making tray 81*a* and a second ice making tray 81*b*.

The first ice making tray 81*a* and the second ice making tray 81*b* may be disposed left and right.

The first ice making tray 81*a* and the second ice making tray 81*b* may be provided to make ice cubes having shapes different from each other. Accordingly, a user may select a desired type of ice from one of the first ice making tray 81*a* and the second ice making tray 81*b*.

However, the present disclosure is not limited thereto, and one of the ice making tray 81 may be provided, or three or more of the ice making trays 81 may be provided.

The refrigerator 1 may include the water supply pipe 90. The water supply pipe 90 may guide water supplied from an external water supply source (not shown) to the ice making tray 81. The water supply pipe 90 may penetrate the outer case 11 and the inner case 12 and be disposed to be directed to the storage compartment 20.

The water supply pipe 90 may be formed of a metal material. The water supply pipe 90 may include a heat insulator (not shown) or a heater (not shown) therein.

A plurality of the water supply pipes 90 may be provided in the refrigerator 1. The water supply pipe 90 may include a first water supply pipe 90*a* provided to supply water to the first ice making tray 81*a* and a second water supply pipe 90*b* provided to supply water to the second ice making tray 81*b*. The first water supply pipe 90*a* and the second water supply pipe 90*b* may be disposed left and right.

However, the present disclosure is not limited thereto, and one or three or more of the water supply pipes 90 may be provided. The number of water supply pipes 90 may correspond to the number of ice making trays 81.

Referring to FIGS. 2 and 3, the water supply pipe 90 may be disposed to be directed to the freezing compartment 21. The water supply pipe 90 may be disposed on the freezing compartment 21 side. However, the present disclosure is not limited thereto, and the water supply pipe 90 may be disposed in another location as long as it may supply water to the ice maker 80.

The water supply pipe 90 may be disposed above the evaporator E. The water supply pipe 90 may be disposed below the blowing fan 51. The water supply pipe 90 may be disposed to avoid parts inside the refrigerator 1.

The water supply pipe 90 may be disposed to be inclined downward from the outer case 11 toward the freezing compartment 21. The water supply pipe 90 may be provided to be inclined downward toward the front. The water supply pipe 90 may be inserted from an upper portion of a rear surface of the refrigerator 1 and disposed to be inclined toward a central portion of the storage compartment 20. Therefore, water in the water supply pipe 90 may be guided to move to the ice making tray 81.

The water supply pipe 90 may penetrate the main body 10. The water supply pipe 90 may penetrate the outer case 11, the heat insulator 15, the inner case 12, and the freezing compartment duct 50. One end of the water supply pipe 90 penetrating the freezing compartment duct 50 may be exposed to the inside of the freezing compartment 21.

The water supply pipe 90 may penetrate the first cooling flow path 41. At least a portion of the water supply pipe 90 may be disposed to pass the first cooling flow path 41.

The water supply pipe 90 may penetrate the second cooling flow path 42. At least a portion of the water supply pipe 90 may be disposed to pass the second cooling flow path 42.

Referring to FIG. 4, the freezing compartment duct 50 may include a passing hole 70 through which a water supply pipe 90 may pass. The passing hole 70 may be a hole formed on the freezing compartment duct 50. The passing hole 70 may be a hole penetrating front and rear surfaces of the freezing compartment duct 50.

The refrigerator 1 may include a cover member 100. The cover member 100 may be coupled to the freezing compartment duct 50. The cover member 100 may cover the passing hole 70.

The cover member 100 may be provided to fix a position of the water supply pipe 90. The cover member 100 may be provided to seal the passing hole 70.

Figure 6:
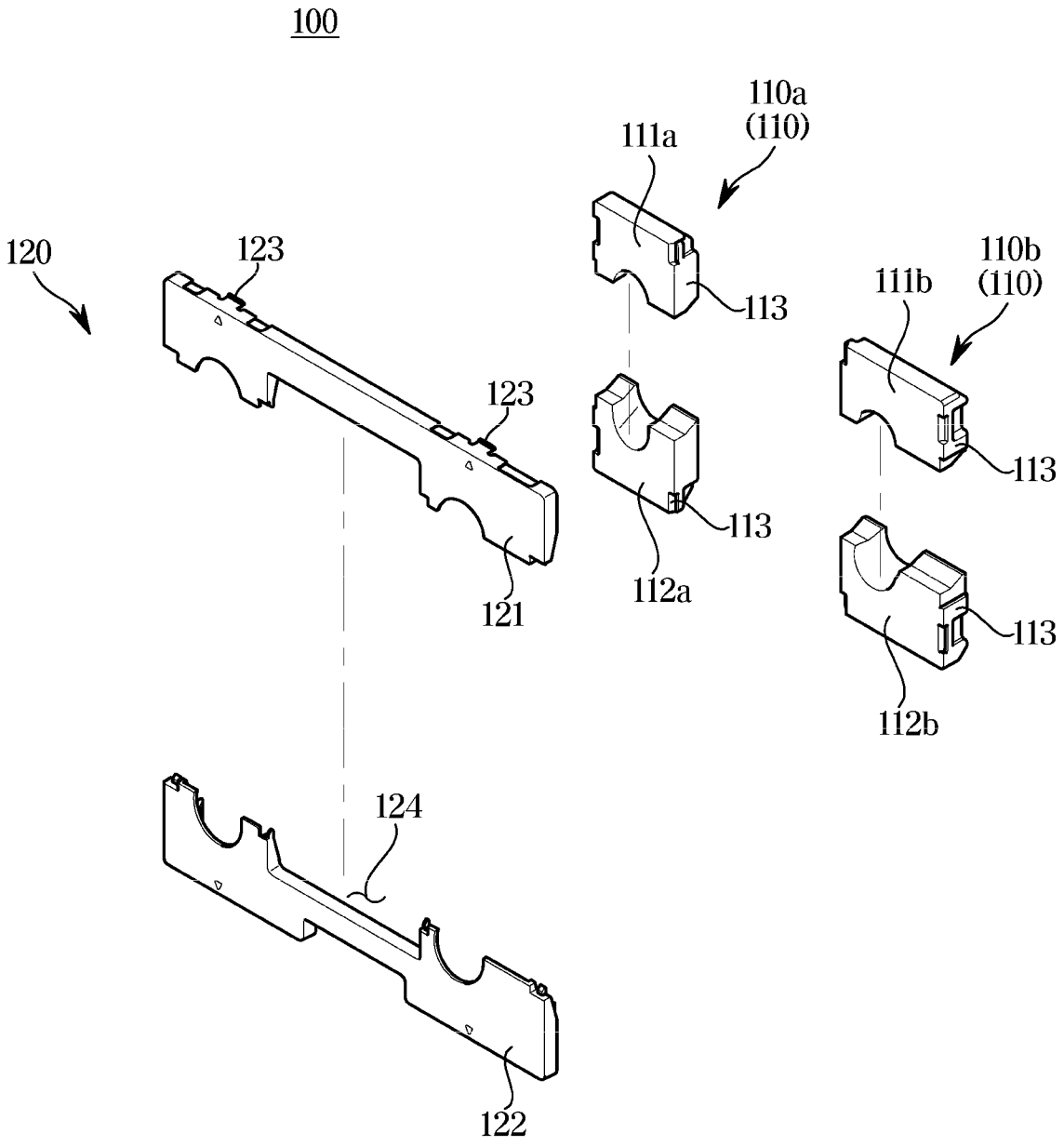
FIG. 6 is an exploded perspective view of a cover member according to an embodiment of the present disclosure.
Figure 7:
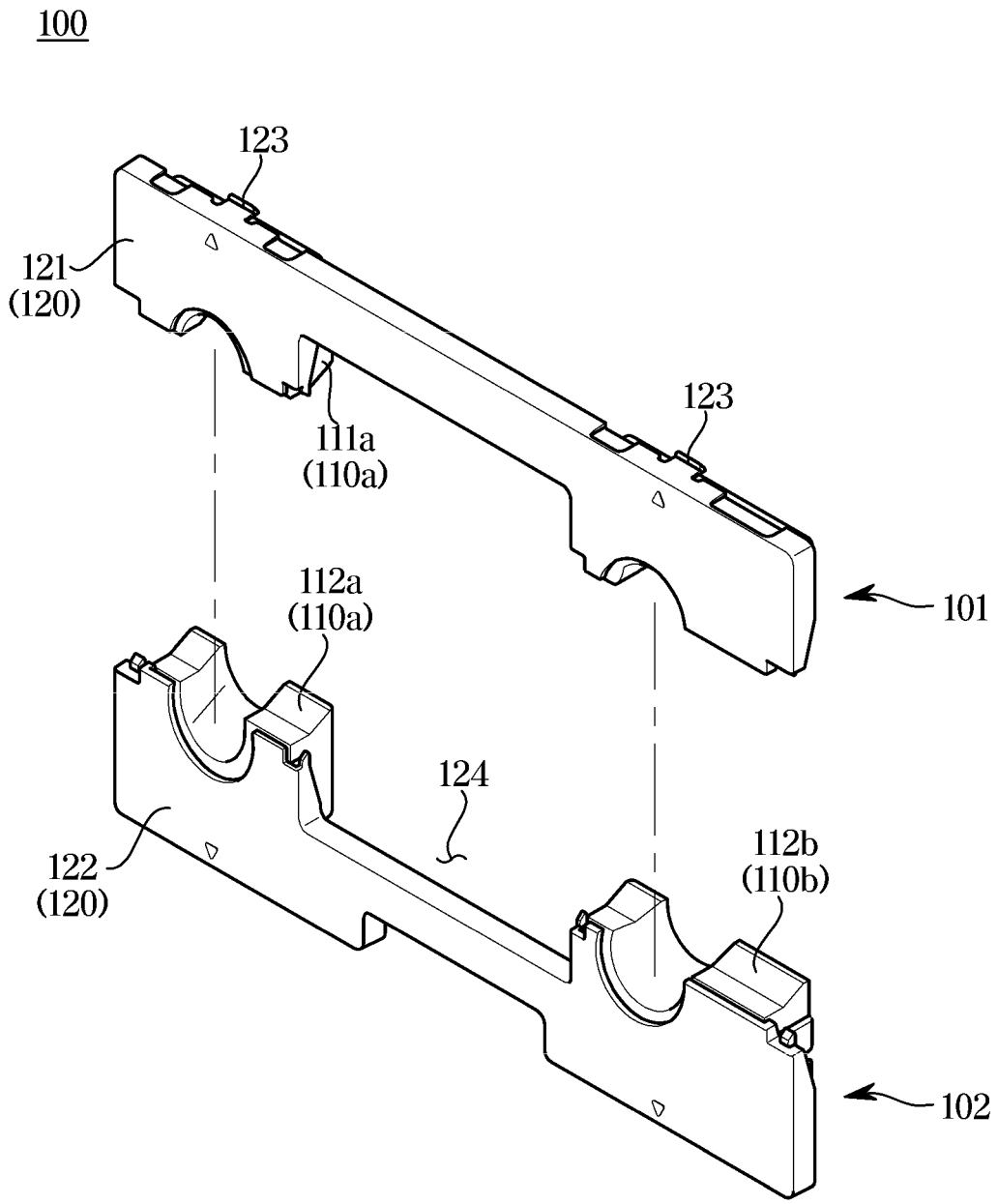
FIG. 7 is a perspective view of the cover member according to an embodiment of the present disclosure.
Figure 8:
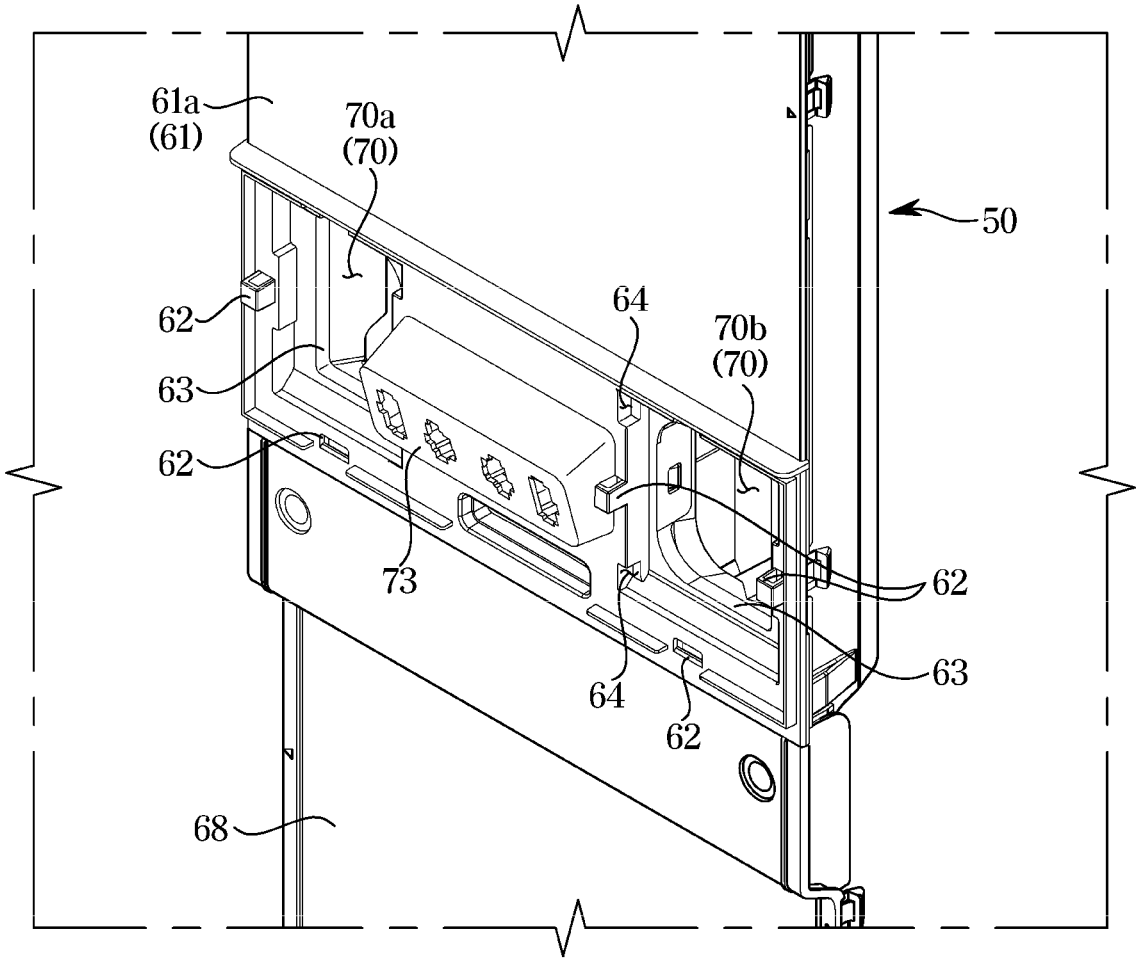
FIG. 8 is an enlarged perspective view of the freezing compartment duct according to an embodiment of the present disclosure.
Figure 9:
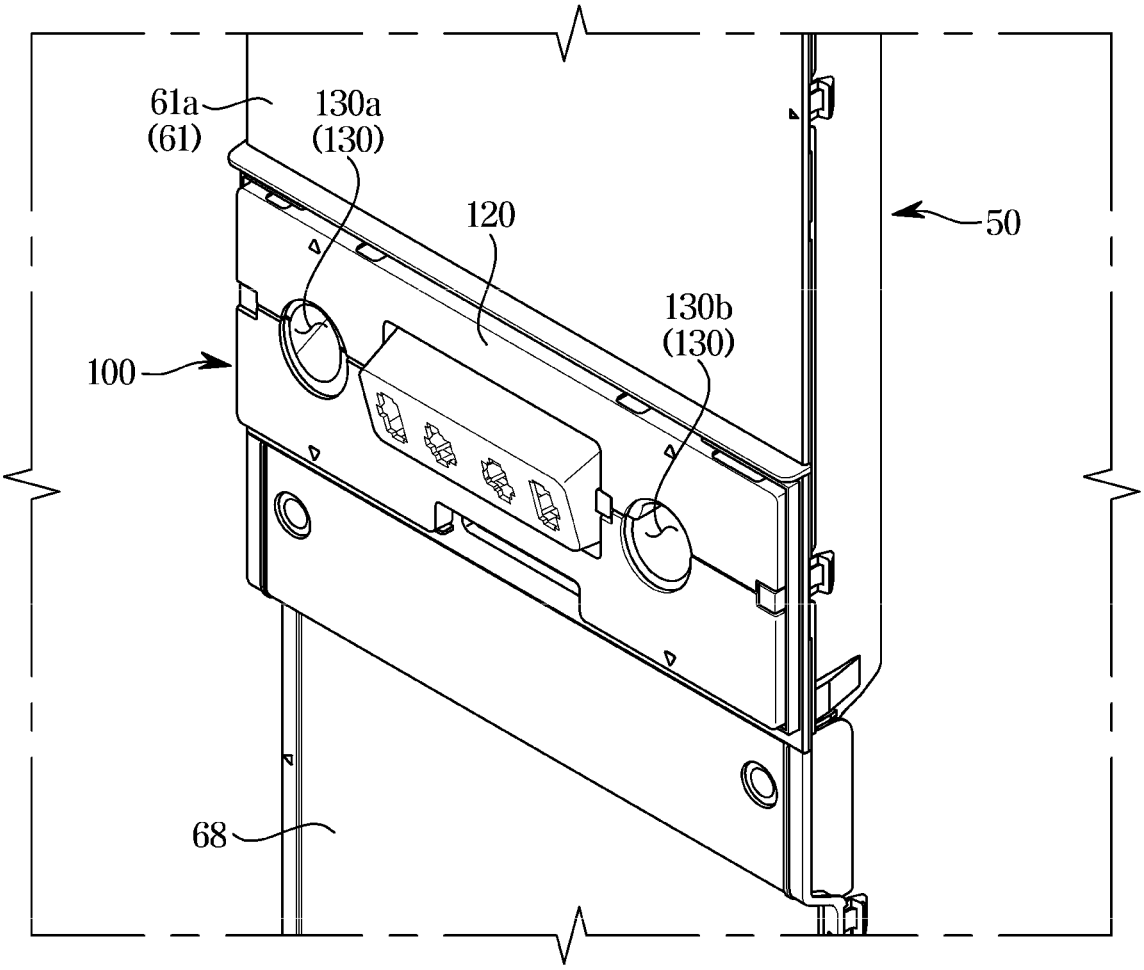
FIG. 9 is an enlarged perspective view of the freezing compartment duct to which the cover member is assembled according to an embodiment of the present disclosure.

FIG. 5 is an exploded perspective view of a freezing compartment duct according to an embodiment of the present disclosure. FIG. 6 is an exploded perspective view of a cover member according to an embodiment of the present disclosure. FIG. 7 is a perspective view of the cover member according to an embodiment of the present disclosure. FIG. 8 is an enlarged perspective view of the freezing compartment duct according to an embodiment of the present disclosure. FIG. 9 is an enlarged perspective view of the freezing compartment duct to which the cover member is assembled according to an embodiment of the present disclosure.

The freezing compartment duct 50 may include a duct plate 61 and a duct cover 65 disposed at the rear of the duct plate 61.

The duct plate 61 may include a duct plate front surface 61*a* forming a rear surface of the storage space 21*a* of the freezing compartment 21. The duct plate 61 may be the front surface 50*a* of the freezing compartment duct 50.

The freezing compartment duct 50 may include a freezing compartment duct insulator 61*b* disposed at the rear of the duct plate 61*a*.

The freezing compartment duct insulator 61*b* may include an expandable polystyrene (EPS) material. The freezing compartment duct insulator 61*b* may be provided between the duct plate 61 and the duct cover 65.

The duct plate 61 and the freezing compartment duct insulator 61*b* may be coupled to each other. However, the present disclosure is not limited thereto, and the duct plate 61 and the freezing compartment duct insulator 61*b* may be integrally formed.

The duct cover 65 may be coupled to the duct plate 61 to form the inner space of the freezing compartment duct 50. However, the present disclosure is not limited thereto, and the duct cover 65 and the duct plate 61 may be integrally formed.

The blowing fan 51 may be disposed in the inner space of the freezing compartment duct 50. The damper 67 may be disposed in the inner space of the freezing compartment duct 50.

The second cooling flow path 42 through which air moves may be formed in the inner space of the freezing compartment duct 50.

The inlet 52 may be formed on the duct cover 65. The inlet 52 may be provided to allow air to be introduced into the freezing compartment duct 50. The inlet 52 may be provided to allow cold air from the first cooling flow path 41 to flow into the second cooling flow path 42. The inlet 52 may be provided such that the blowing fan 51 may suck in air.

The inlet 52 may be provided to correspond to a shape of the blowing fan 51. The inlet 52 may be provided to have a substantially circular shape.

The freezing compartment outlet 54 may be formed on the duct plate 61. The freezing compartment outlet 54 may be formed to extend left and right.

The first freezing compartment outlet 54*a* is disposed an upper portion of the duct plate 61 so that cold air may be supplied to an upper portion of the freezing compartment 21. The second freezing compartment outlet 54*b* may be disposed below the first freezing compartment outlet 54*a*.

The duct cover 65 may include a damper housing 66 extending to the rear of the duct cover 65 to cover the damper 67 and having a shape substantially similar to an outer appearance of the damper 67. The damper 67 may be accommodated in the damper housing 66.

The damper housing 66 may be integrally formed with the duct cover 65. However, the present disclosure is not limited thereto, and the damper housing 66 may be provided as a separate configuration from the duct cover 65 or may be provided in a form coupled to the duct cover 65.

The connection outlet 55 may be formed in the duct cover 65. The connection outlet 55 may be formed on the damper housing 66. The connection outlet 55 may be disposed adjacent to the damper 67.

The freezing compartment duct 50 may include a separation plate 68. The separation plate 68 may be disposed below the duct plate 61 and/or the duct cover 65. The separation plate 68 may be coupled to the duct plate 61 and/or the duct cover 65. However, the present disclosure is not limited thereto, and the freezing compartment duct 50 may be integrally formed.

The separation plate 68 together with the duct plate 61 may form the rear surface of the freezing compartment 21.

The separation plate 68 together with the duct cover 65 may be provided to form the first cooling flow path 41. The first cooling flow path 41 may be formed by the rear surface 12*a* of the freezing compartment inner case 12 and the rear surface of the freezing compartment duct 50 (see FIG. 2).

The freezing compartment duct 50 may include the passing hole 70. The passing hole 70 may include duct plate passing holes 71*a* and 71*b* formed on the duct plate 61 and duct cover passing holes 72*a* and 72*b* formed on the duct cover 65. The duct plate passing holes 71*a* and 71*b* and the duct cover passing holes 72*a* and 72*b* may be formed at positions corresponding to each other.

The duct plate passing holes 71*a* and 71*b* may be provided to communicate an inner space of the freezing compartment 21 and the second cooling flow path 42. The storage space 21*a* of the freezing compartment 21 and the inner space of the freezing compartment duct 50 may communicate with each other through the duct plate passing holes 71*a* and 71*b*.

The duct cover passing holes 72*a* and 72*b* may be provided to communicate the second cooling flow path 42 and the first cooling flow path 41. The inner space of the freezing compartment duct 50 and the cooling space 21*b* of the freezing compartment 21 disposed at the rear of the freezing compartment duct 50 may communicate with each other through the duct cover passing holes 72*a* and 72*b*.

A plurality of the passing holes 70 may be provided. The passing hole 70 may include a first passing hole 70*a* through which the first water supply pipe 90*a* may pass and a second passing hole 70*b* through which the second water supply pipe 90*b* may pass. The first passing hole 70*a* and the second passing hole 70*b* may be disposed in the left-right direction.

However, the present disclosure is not limited thereto, and one or three or more of the passing holes 70 may be provided. The number of passing holes 70 may be provided to correspond to the number of water supply pipes 90.

The passing hole 70 may have a substantially rectangular shape. However, the present disclosure is not limited thereto, and the passing hole 70 may be provided in various shapes such as a circular shape.

The passing hole 70 may be formed to be equal to or larger than the diameter of the water supply pipe 90.

The freezing compartment duct 50 may include a wire accommodating part 73. The wire accommodating part 73 may be provided to accommodate a wire connected to the ice maker 80. The wire accommodating part 73 may be provided between the first passing hole 70*a* and the second passing hole 70*b*.

The wire (not shown) may be inserted from the freezing compartment inner case 13 to a side of the freezing compartment duct 50 and disposed between the duct plate 61 and the freezing compartment duct insulator 61*b*. The wire (not shown) may be connected to the ice maker 80 disposed in the freezing compartment 21 through a hole formed on the wire accommodating part 73.

The cover member 100 may be disposed in front of the freezing compartment duct 50.

Referring to FIG. 6, the cover member 100 may include a body part 110 and a cover part 120 disposed in front of the body part 110. The body part 110 and the cover part 120 may be coupled to each other. However, the present disclosure is not limited thereto, and the cover member 100 may be integrally formed. The body part 110 and the cover part 120 may be integrally formed.

The body part 110 and/or the cover part 120 may include an expandable polystyrene (EPS) material.

The body part 110 may be provided to seal the duct plate passing holes 71*a* and 71*b*. The body part 110 may be provided in a block shape.

The body part 110 may include a coupling protrusion 113 provided to be coupled to the freezing compartment duct 50. The coupling protrusion 113 may be formed to protrude. A plurality of the coupling protrusions 113 may be provided in the body part 100.

The body part 110 may include a first body part 110*a* provided to seal the first passing hole 70*a* and a second body part 110*b* provided to close the second passing hole 70*b*.

The first body part 110*a* and the second body part 110*b* may be disposed left and right. The first body part 110*a* and the second body part 110*b* may be spaced apart from each other.

The first body part 110*a* may include an upper first body part 111*a* and a lower first body part 112*a* separable from the upper first body part 111*a*. The second body part 110*b* may include an upper second body part 111*b* and a lower second body part 112*b* separable from the upper second body part 111*b*.

However, the present disclosure is not limited thereto, and the first body part 110*a* and/or the second body part 110*b* may be integrally formed.

The cover member 100 may include the cover part 120. The cover part 120 may be provided to cover the body part 110. The cover part 120 may be provided to cover the first body part 110*a* and/or the second body part 110*b*.

The cover part 120 may extend left and right long. The cover part 120 may be provided in a plate shape.

The cover part 120 may include a hook 123 provided to be coupled to the freezing compartment duct 50. A plurality of the hooks 123 may be provided in the cover part 120. The hook 123 may be provided at an end of the cover part.

The cover part 120 may include an upper cover part 121 and a lower cover part 122 separable from the upper cover part.

However, the present disclosure is not limited thereto, and the cover part 120 may be integrally formed.

The cover part 120 may include a wire passing hole 124. The wire passing hole 124 may be formed to allow the wire provided to supply power to the ice maker 80 to pass therethrough.

The wire passing hole 124 may be formed substantially at a center of the cover part 120. The wire passing hole 124 may be disposed between the first body part 110*a* and the second body part 110*b*.

The wire passing hole 124 may extend left and right. The wire passing hole 124 may have a substantially rectangular shape. However, the present disclosure is not limited thereto, and the wire passing hole 124 may have various shapes such as a circular shape.

Referring to FIG. 7, the body part 110 and the cover part 120 may be coupled to each other. The body part 110 and the cover part 120 may be integrally formed.

The cover member 100 may include an upper cover member 101 and a lower cover member 102 separable from the upper cover member 101. However, the present disclosure is not limited thereto, and the cover member 100 may be integrally formed.

The upper cover member 101 may include the upper first body part 111*a*, the upper second body part 111*b*, and the upper cover part 121.

The lower cover member 102 may include the lower first body part 112*a*, the lower second body part 112*b*, and the lower cover part 122.

The cover member 100 may include an expandable polystyrene (EPS) material.

Referring to FIG. 8, the duct plate 61 may include an accommodating portion 63 capable of accommodating the body part 110. The accommodating portion 63 may be formed to be recessed toward the rear to accommodate the body part 110. The accommodating portion 63 may be disposed adjacent to the duct plate passing holes 71*a* and 71*b*. The accommodating portion 63 may be formed to surround the passing hole 70. The body part 110 may be seated on the accommodating portion 63. The body part 110 may be inserted into the passing hole 70.

The accommodating portion 63 may include a coupling groove 64 provided such that the body part 110 is coupled to the coupling groove 64. The coupling groove 64 may be provided to correspond to the coupling protrusion 113 of the body part 110.

The duct plate 61 may include a coupling hole 62 provided such that the cover part 120 is coupled to the coupling hole 62. The coupling hole 62 may be provided to correspond to the hook 123 of the cover part 120. A plurality of the coupling holes 62 may be provided up, down, left and right.

Referring to FIG. 9, the cover member 100 may include a cover member hole 130. The cover member hole 130 may be provided to allow the water supply pipe 90 to pass therethrough. The cover member hole 130 may be disposed to correspond to a position of the passing hole 70 of the freezing compartment duct 50.

A plurality of the cover member holes 130 may be provided. The cover member hole 130 may include a first cover member hole 130*a* provided to allow the first water supply pipe 90*a* to pass therethrough and a second cover member hole 130*b* provided to allow the second water supply pipe 90*b* to pass therethrough. The first cover member hole 130*a* and the second cover member hole 130*b* may correspond to the first passing hole 70*a* and the second passing hole 70*b*, respectively.

However, the present disclosure is not limited thereto, and one or three or more of the cover member holes 130 may be provided.

Figure 10:
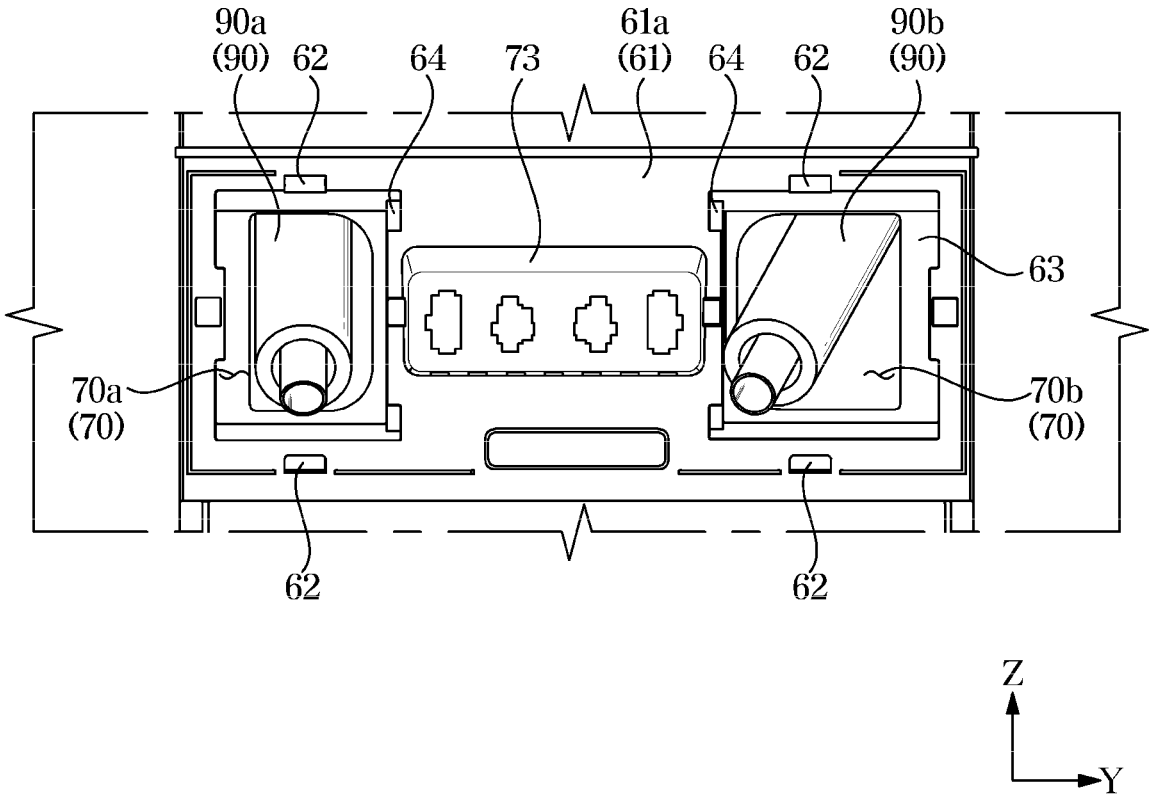
FIG. 10 is a view illustrating a state before the cover member is assembled to the freezing compartment duct according to an embodiment of the present disclosure.
Figure 11:
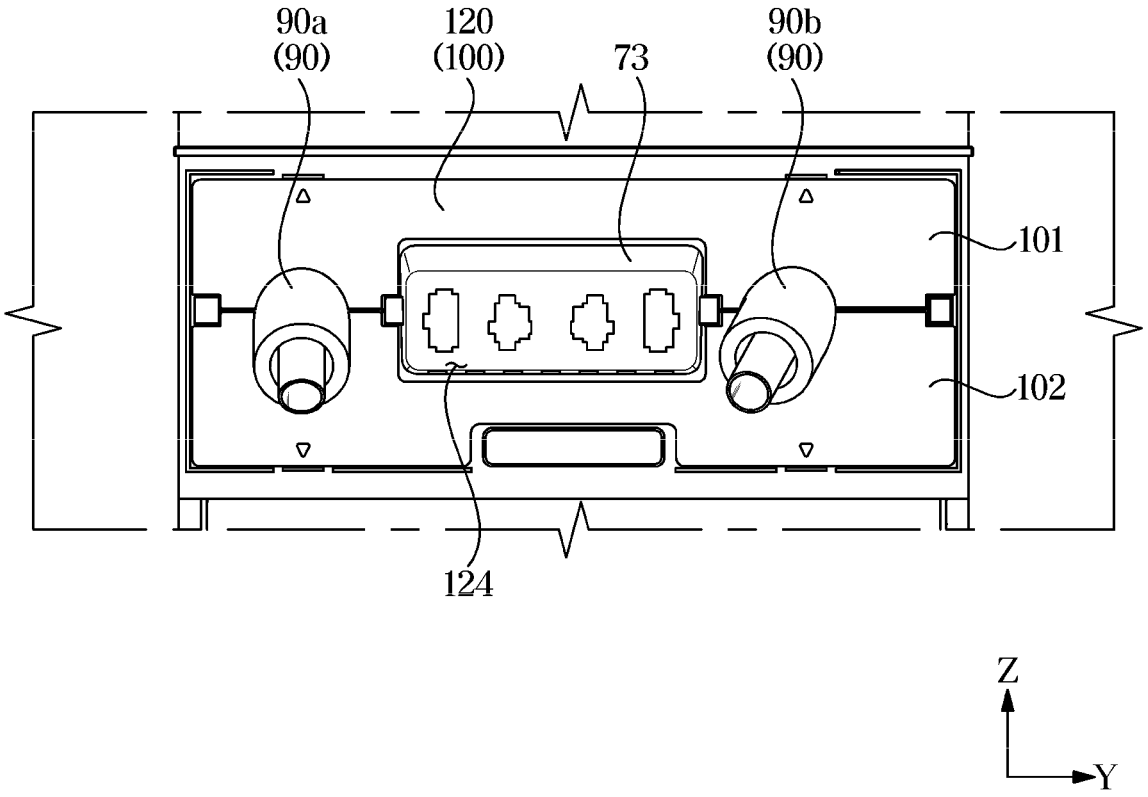
FIG. 11 is a view illustrating a state in which the cover member is assembled to the freezing compartment duct according to an embodiment of the present disclosure.

FIG. 10 is a view illustrating a state before the cover member is assembled to the freezing compartment duct according to an embodiment of the present disclosure. FIG. 11 is a view illustrating a state in which the cover member is assembled to the freezing compartment duct according to an embodiment of the present disclosure.

Referring to FIG. 10, the water supply pipe 90 may be disposed to penetrate the freezing compartment duct 50. The passing hole 70 is disposed to penetrate the freezing compartment 21 and the first cooling flow path 41 so that cold air in the first cooling flow path 41 may be introduced into the freezing compartment 21 through the passing hole 70. Conversely, cold air in the freezing compartment 21 may be introduced into the first cooling flow path 41.

Referring to FIG. 11, in order to prevent the cold air from being introduced into the first cooling flow path 41 and the cold air from being introduced into the freezing compartment 21, the cover member 100 may be coupled to the passing hole 70. The coupling protrusion 113 of the body part 110 may be coupled to the coupling groove 64 of the accommodating portion 63 of the duct plate 61, and the hook 123 of the cover part 120 may be coupled to the coupling hole 62 of the duct plate 61.

The user may couple the cover member 100 from the front of the freezing compartment duct 50. Therefore, assembly of the cover member 100 may be facilitated.

The user may first couple the upper cover member 101 such that the cover member hole 130 corresponds to the position of the water supply pipe 90, and then couple the lower cover member 102. However, the present disclosure is not limited thereto, and the order and method of assembling the upper cover member 101 and the lower cover member 102 may be implemented in various ways.

The cover member hole 130 of the cover member 100 may be formed to be smaller than a size of the passing hole 70. The cover member hole 130 may be formed to correspond to a diameter of the water supply pipe 90. The cover member 100 may block a movement of cold air between the first cooling flow path 41 and the freezing compartment 21 by sealing a gap between the passing hole 70 and the water supply pipe 90. Therefore, malfunction of a cooling system of the refrigerator 10 may be prevented.

The water supply pipe 90 may be disposed to be inclined downward toward the storage compartment 20. The cover member hole 130 is formed to correspond to a size of the water supply pipe 90, thereby fixing the position of the water supply pipe 90.

Figure 12:
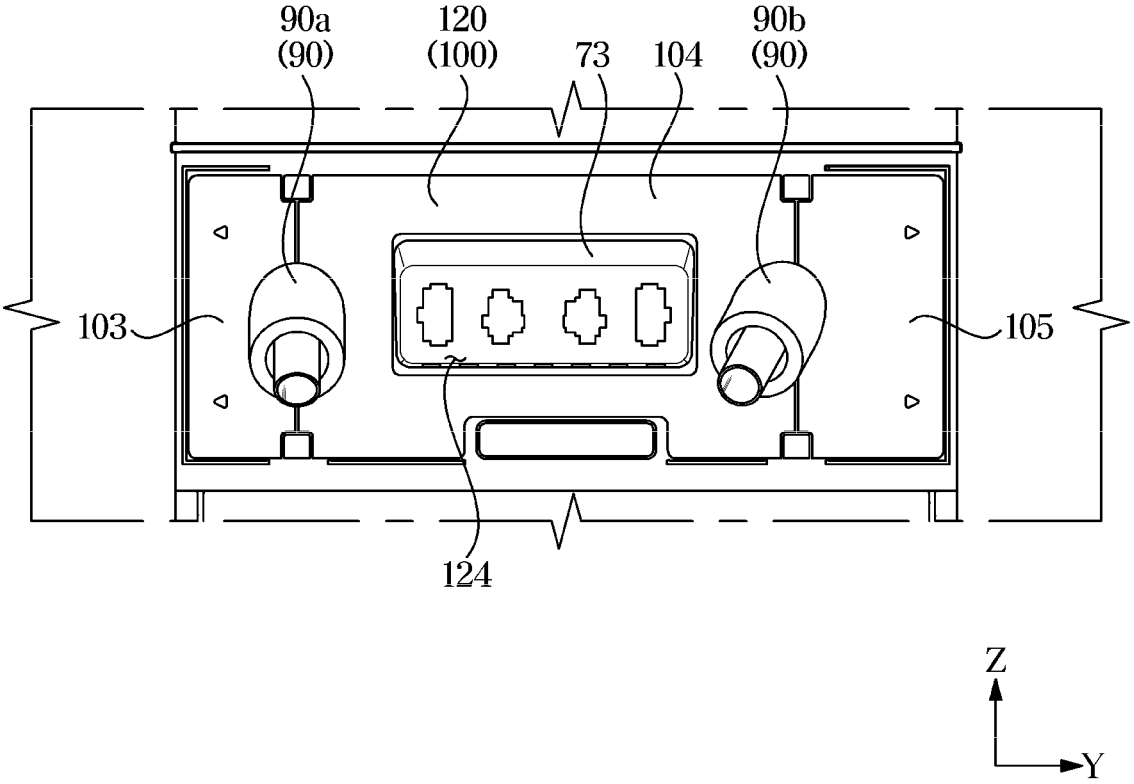
FIG. 12 is a view illustrating a state in which the cover member is assembled to the freezing compartment duct according to another embodiment of the present disclosure.

FIG. 12 is a view illustrating a state in which the cover member is assembled to the freezing compartment duct according to another embodiment of the present disclosure.

The cover member 100 may be coupled in the left-right direction. The cover member 100 may include a first side cover member 103, a second side cover member 105, and an intermediate cover member 104 disposed between the first side cover member 103 and the second side cover member 105. Redundant descriptions are omitted.

Figure 13:
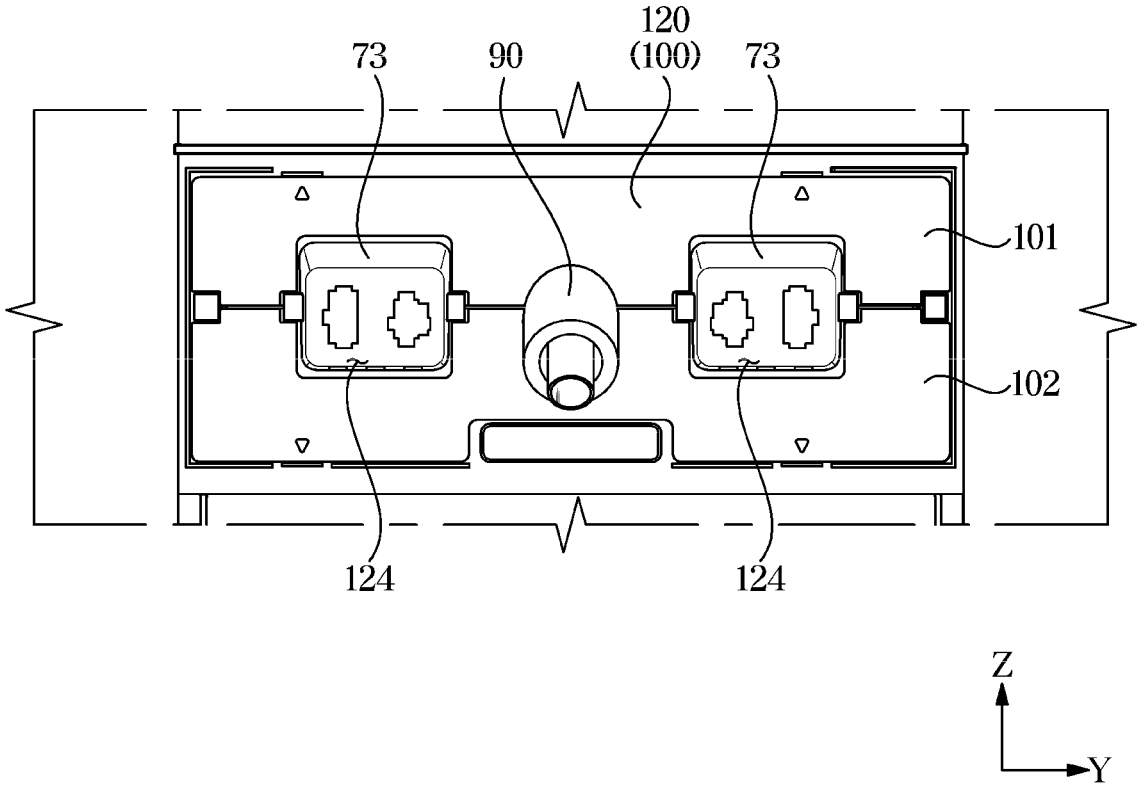
FIG. 13 is a view illustrating a state in which the cover member is assembled to the freezing compartment duct according to another embodiment of the present disclosure.

FIG. 13 is a view illustrating a state in which the cover member is assembled to the freezing compartment duct according to another embodiment of the present disclosure.

The one water supply pipe 90 may be provided. For example, the one ice making tray 81 of the ice maker 80 is provided and thus the one water supply pipe 90 for supplying water to the ice making tray 81 may also be provided, and although the two or more ice making trays 81 are provided, the one water supply pipe 90 for supplying water to the plurality of ice making trays 81 may be provided.

The water supply pipe 90 may be disposed to penetrate a substantially center of the freezing compartment duct 50. However, the present disclosure is not limited thereto.

The one passing hole 70 may be provided. The passing hole 70 may be formed at the position where the water supply pipe 90 is disposed. The passing hole 70 may be disposed at the substantially center of the freezing compartment duct 50. However, the present disclosure is not limited thereto.

The cover member 100 may be coupled in the vertical direction. The cover member 100 may include the upper cover member 101 and the lower cover member 102. The one cover member hole 130 may be provided. The cover member hole 130 may be provided to correspond to the position of the water supply pipe 90 and/or the passing hole 70. Redundant descriptions are omitted.

Figure 14:
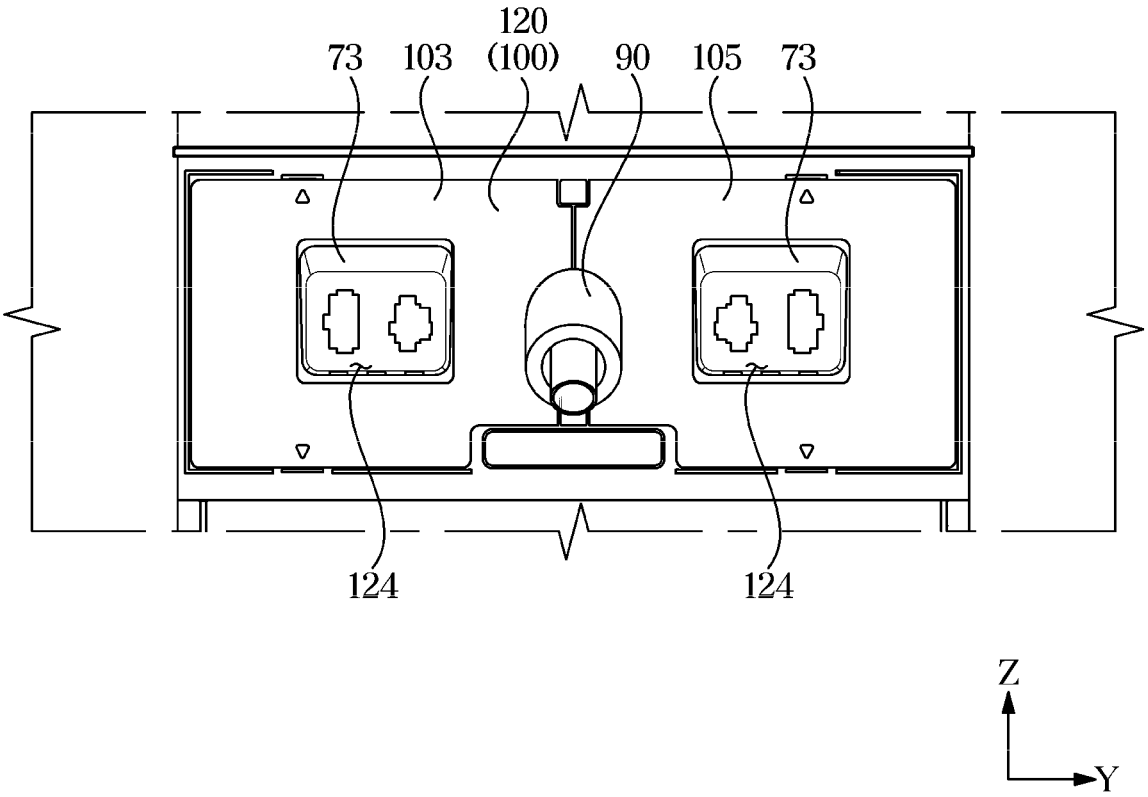
FIG. 14 is a view illustrating a state in which the cover member is assembled to the freezing compartment duct according to another embodiment of the present disclosure.

FIG. 14 is a view illustrating a state in which the cover member is assembled to the freezing compartment duct according to another embodiment of the present disclosure.

The cover member 100 may be coupled in the left-right direction. The cover member 100 may include the first side cover member 103 and the second side cover member 105. Redundant descriptions are omitted.

The embodiments of FIGS. 12 to 14 may be combined with the embodiment of FIGS. 1 to 10.

According to the present disclosure, a position of a water supply pipe supplying water to an ice maker may be fixed.

According to the present disclosure, inflow of cold air from the outside into a storage compartment can be prevented.

The present disclosure is directed to providing a refrigerator capable of preventing cold air in a storage compartment from escaping to the outside.

Effects according to the present disclosure are not limited to the effects mentioned above, and other effects not mentioned will be clearly understood by those skilled in the art from the description.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

What is claimed is:

1. A refrigerator comprising:

a main body;

a freezing compartment and a refrigerating compartment disposed inside the main body;

an evaporator provided to supply cold air to the freezing compartment;

a freezing compartment duct disposed in the freezing compartment to supply cold air generated by the evaporator to the freezing compartment;

a first cooling flow path formed at a rear of the freezing compartment duct, wherein the evaporator is disposed in the first cooling flow path;

a second cooling flow path formed inside the freezing compartment duct so that air passed through the first cooling flow path moves to the freezing compartment;

an ice maker disposed inside the main body;

a water supply pipe provided to penetrate the first cooling flow path and the second cooling flow path to be directed to the ice maker; and a cover member coupled to the freezing compartment duct, wherein the freezing compartment duct comprises:

a duct plate forming a front surface of the freezing compartment duct, a duct cover coupled to a rear side of the duct plate to form the second cooling flow path, and a passing hole provided on the duct plate and the duct cover to allow the water supply pipe to pass the passing hole, and wherein the cover member is coupled to a front side of the duct plate to block a movement of air between the first cooling flow path and the freezing compartment and provided to cover the passing hole.

2. The refrigerator according to claim 1, wherein the cover member comprises a cover member hole provided to allow the water supply pipe to pass through the cover member hole, and wherein the cover member hole is formed to correspond to a diameter of the water supply pipe to fix the water supply pipe.

3. The refrigerator according to claim 1, wherein the cover member comprises:

a body part provided to seal the passing hole; and a cover part disposed in front of the body part and coupled to the duct plate.

4. The refrigerator according to claim 3, wherein the cover part comprises a wire passing hole provided to allow a wire provided to supply power to the ice maker to pass through the wire passing hole.

5. The refrigerator according to claim 3, wherein the passing hole comprises:

a duct cover passing hole formed on the duct cover to communicate the first cooling flow path and the second cooling flow path; and a duct plate passing hole formed on the duct plate to communicate the second cooling flow path and an inner space of the freezing compartment.

6. The refrigerator according to claim 5, wherein the duct plate comprises an accommodating portion disposed adjacent to the duct plate passing hole and recessed to accommodate the body part.

7. The refrigerator according to claim 6, wherein the accommodating portion comprises a coupling groove provided such that the body part is coupled to the coupling groove, and wherein the body part comprises a coupling protrusion provided to correspond to the coupling groove.

8. The refrigerator according to claim 3, wherein the duct plate comprises a coupling hole provided to allow the cover part to be coupled to the coupling hole, and wherein the cover part comprises a hook provided to correspond to the coupling hole.

9. The refrigerator according to claim 3, wherein the ice maker comprises a first ice making tray and a second ice making tray provided to make ice cubes having shapes different from each other, the water supply pipe comprises a first water supply pipe provided to supply water to the first ice making tray and a second water supply pipe provided to supply water to the second ice making tray, the passing hole comprises a first passing hole provided to allow the first water supply pipe to pass through the first passing hole and a second passing hole provided to allow the second water supply pipe to pass through the second passing hole, and the body part comprises a first body part provided to cover the first passing hole and a second body part provided to cover the second passing hole.

10. The refrigerator according to claim 9, wherein the first body part and the second body part are disposed to be spaced apart from each other.

11. The refrigerator according to claim 3, wherein the cover part comprises an upper cover part and a lower cover part separable from the upper cover part.

12. The refrigerator according to claim 1, further comprising a blowing fan disposed inside the freezing compartment duct to generate flows in the first cooling flow path and the second cooling flow path, wherein the cover member is disposed below the blowing fan.

13. The refrigerator according to claim 1, wherein the cover member is disposed above the evaporator.

14. The refrigerator according to claim 1, wherein the cover member comprises an expandable polystyrene (EPS) material.

15. The refrigerator according to claim 1, wherein the water supply pipe is disposed to be inclined downward toward the freezing compartment.

16. The refrigerator according to claim 1, wherein the ice maker comprises a first ice making tray and a second ice making tray provided to make ice cubes having shapes different from each other, the water supply pipe comprises a first water supply pipe provided to supply water to the first ice making tray and a second water supply pipe provided to supply water to the second ice making tray, the passing hole comprises a first passing hole provided to allow the first water supply pipe to pass through the first passing hole and a second passing hole provided to allow the second water supply pipe to pass through the second passing hole, and the cover member comprises a first side cover member, a second side cover member and an intermediate cover member disposed between the first side cover member and the second side cover member.

17. A refrigerator comprising:

a main body;

a freezing compartment and a refrigerating compartment disposed inside the main body;

an evaporator disposed in a cooling flow path and provided to supply cold air to the freezing compartment;

a freezing compartment duct disposed in the freezing compartment to supply cold air generated by the evaporator to the freezing compartment;

an ice maker disposed inside the main body;

a water supply pipe provided to penetrate the cooling flow path to be directed to the ice maker; and a cover member coupled to the freezing compartment duct, wherein the freezing compartment duct comprises:

a duct plate forming a front surface of the freezing compartment duct, a duct cover coupled to a rear side of the duct plate, and a passing hole provided on the duct plate and the duct cover to allow the water supply pipe to pass through the passing hole, and wherein the cover member is coupled to a front side of the duct plate to block a movement of air between the cooling flow path and the freezing compartment and provided to cover the passing hole.

18. The refrigerator according to claim 17, wherein the cover member comprises a cover member hole provided to allow the water supply pipe to pass through the cover member hole, and wherein the cover member hole is formed to correspond to a diameter of the water supply pipe to fix the water supply pipe.

19. The refrigerator according to claim 17, wherein the cover member comprises:

a body part provided to seal the passing hole; and a cover part disposed in front of the body part and coupled to the duct plate.

20. The refrigerator according to claim 19, wherein the cover part comprises a wire passing hole provided to allow a wire provided to supply power to the ice maker to pass through the wire passing hole.

* * * * *